US008740322B2

(12) United States Patent
Moon et al.

(10) Patent No.: US 8,740,322 B2
(45) Date of Patent: Jun. 3, 2014

(54) REFRIGERATOR WITH SLIDABLE SHELF

(75) Inventors: Young Kyu Moon, Buk-gu (KR); Hyun Sang Yoo, Gwangsan-gu (KR); Sang Bum Kim, Gwangju (KR); Yun Ho Yang, Yongin-si (KR); Sang Woon Jeon, Gyeonggi-do (KR); Hyoung Min Go, Gwang-ju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 99 days.

(21) Appl. No.: 13/443,424

(22) Filed: Apr. 10, 2012

(65) Prior Publication Data

US 2012/0267993 A1 Oct. 25, 2012

(30) Foreign Application Priority Data

Apr. 11, 2011 (KR) ..... 10-2011-0033025

(51) Int. Cl.
*A47B 96/04* (2006.01)

(52) U.S. Cl.
USPC ..... 312/408

(58) Field of Classification Search
USPC ..... 108/108, 143; 312/404, 405.1, 408, 312/410, 334.7, 334.8, 334.44, 334.46
See application file for complete search history.

(56) References Cited

U.S. PATENT DOCUMENTS

| | | | | |
|---|---|---|---|---|
| 4,953,990 | A * | 9/1990 | Wojcik | 384/18 |
| 5,813,741 | A * | 9/1998 | Fish et al. | 312/408 |
| 6,220,684 | B1 * | 4/2001 | Bent et al. | 312/405.1 |
| 2009/0056365 | A1 * | 3/2009 | Benz et al. | 62/441 |
| 2009/0188877 | A1 * | 7/2009 | Stewart | 211/71.01 |
| 2009/0256455 | A1 * | 10/2009 | Ho | 312/334.7 |
| 2010/0001624 | A1 * | 1/2010 | Placke et al. | 312/405 |

* cited by examiner

*Primary Examiner* — Matthew Ing
(74) *Attorney, Agent, or Firm* — Staas & Halsey LLP

(57) ABSTRACT

A refrigerator includes a sliding rail assembly of a triple rail type, which is slidably installed to a sidewall of a storage compartment, a rail cover to cover the sliding rail assembly, and a sliding shelf removably coupled at one end thereof to the rail cover so as to slide forward or rearward relative to the storage compartment, which prevents sagging of the sliding shelf despite an increased withdrawal distance of the shelf, and results in enhanced quality.

25 Claims, 13 Drawing Sheets

REFRIGERATOR WITH SLIDABLE SHELF

CROSS-REFERENCE TO RELATED APPLICATIONS

This application claims the priority benefit of Korean Patent Application No. 2011-0033025, filed on Apr. 11, 2011 in the Korean Intellectual Property Office, the disclosure of which is incorporated herein by reference.

BACKGROUND

1. Field

The following description relates to a refrigerator having a shelf slidably installed to a sidewall of a storage compartment.

2. Description of the Related Art

Generally, a refrigerator is an apparatus that stores food at a low temperature by supplying low-temperature air into a storage compartment in which the food is stored. The refrigerator includes a freezing compartment in which food is kept at or below a freezing temperature and a refrigerating compartment in which food is kept at a temperature slightly above freezing.

The cold air to be supplied into the refrigerator is produced by heat exchange of refrigerant and is continuously supplied into the refrigerator with repeated implementation of a refrigeration cycle consisting of compression, condensation, expansion, and evaporation. The supplied cold air is uniformly distributed within the refrigerator by convection, enabling food stored in the refrigerator to be kept at a desired temperature.

In recent years, a variety of large-scale refrigerators has been released to meet requirements of living convenience and storage spaces. The storage compartment of the refrigerator is equipped with at least one shelf on which articles are placed for optimal spatial utilization of the storage compartment.

SUMMARY

As one example of refrigerator shelves, there is disclosed a sliding shelf to be withdrawn forward of the storage compartment for convenience. Such a sliding shelf is withdrawable forward from above a shelf support member in the form of a cantilever that in turn, is supported by a rear wall of the storage compartment.

Therefore, it is one aspect to provide a refrigerator having a sliding shelf which has an increased withdrawal distance and is operable with low force.

It is another aspect to provide a refrigerator having a sliding shelf which exhibits enhanced convenience and reliability.

It is a further aspect to provide a refrigerator having a shelf which assists in effectively utilizing a space of a storage compartment.

Additional aspects will be set forth in part in the description which follows and, in part, will be obvious from the description, or may be learned by practice of the invention.

In accordance with one aspect, a refrigerator includes a main body having a storage compartment divided into upper and lower regions by an intermediate partition, the main body including an inner shell defining the storage compartment and an outer shell spaced apart from the inner shell with a thermal-insulating material interposed between the inner shell and the outer shell, a door to open or close the storage compartment, a first shelf removably mounted to a rear wall of the inner shell in a height adjustable manner, a second shelf horizontally aligned with the first shelf between the first shelf and a sidewall of the inner shell, and a sliding unit to move the second shelf forward or rearward relative to the storage compartment, wherein the sliding unit includes a sliding rail assembly slidably installed to the sidewall of the inner shell, and a rail cover coupled to the second shelf and configured to cover the sliding rail assembly to prevent exposure of the sliding rail assembly.

The refrigerator may further include a guide provided between the first shelf and the second shelf to support one end of the second shelf when the second shelf is moved while being supported at the other end thereof by the sliding unit, thereby guiding movement of the second shelf.

The guide may include a roller member installed to a lateral surface of the first shelf, and a roller support recess is formed in a lateral surface of the second shelf so as to come into contact with the roller member.

The sliding unit may have a length less than a front-and-rear length of the storage compartment and may be moved between a front end and a rear end of the storage compartment.

The second shelf may include an article carrying surface on which an article will be placed, and a coupling frame extending orthogonal to the article carrying surface and coupled to the rail cover.

The sliding unit may further include a fixed bracket coupled to the inner shell so as to support the sliding rail assembly, and the rail cover may be coupled to the sliding rail assembly so as to be moved along with the sliding rail assembly.

The sliding rail assembly may include a rail fixing member to come into contact with the fixed bracket at a maximally inserted position of the second shelf, thereby restricting movement of the sliding unit by friction.

The sliding rail assembly may include a first rail secured to the fixed bracket, a second rail slidably coupled to the first rail and having a length greater than that of the first rail, and a third rail secured to the rail cover to be moved relative to the second rail and having a length greater than that of the second rail.

The sliding rail assembly may include a position control bump formed of an elastic material, the position control bump coming into contact with the sliding rail assembly to restrict the maximum withdrawal distance of the second shelf when the second shelf is withdrawn.

The fixed bracket may include a rolling member to support a lower portion of the rail cover in order to guide smooth movement of the rail cover and prevent the rail cover from sagging by external force applied to the rail cover.

The coupling frame may include a wire arm vertically pivotally coupled thereto to prevent separation of an article, the wire arm extending along an edge of the article carrying surface at the upper side of the edge.

The wire arm may include a pair of horizontal portions vertically spaced apart from each other and having a bent shape corresponding to the periphery of the second shelf, a pair of vertical portions connecting opposite distal ends of the pair of horizontal portions to each other, and a pair of rotating shafts extending from the pair of vertical portions and coupled to the coupling frame, and each of the pair of rotating shafts may be provided with a stopper member to restrict a pivoting angle of the wire arm.

The coupling frame may include a stopper receptacle configured to accommodate the stopper member, the stopper receptacle having a plurality of stopper grooves vertically spaced apart from each other, and the stopper member may include a stopper boss to be caught by a corresponding one of the plurality of stopper grooves according to the pivoting angle of the wire arm.

The stopper receptacle may include a restraint bore to restrain pivoting of the wire arm in a vertically folded (raised) state of the wire arm, and the stopper member may include a press-fit rod to be press-fitted into the restraint bore in the vertically folded (raised) state of the wire arm.

The second shelf may be removable from the rail cover, the rail cover may be provided at opposite sides thereof with a pair of fitting portions to allow the second shelf to be coupled to the rail cover when the second shelf is moved downward from above the rail cover, and the coupling frame may be provided with a pair of indented fitting regions corresponding to the pair of fitting portions.

In accordance with another aspect, a refrigerator includes a main body including an inner shell defining a storage compartment, an outer shell spaced apart from the inner shell, and a thermal-insulating material interposed between the inner shell and the outer shell, a door coupled to the main body to open or close the storage compartment, a sliding unit including a fixed bracket secured to a sidewall of the inner shell so as to slide forward or rearward relative to the storage compartment, a sliding rail assembly coupled to the fixed bracket, and a rail cover coupled to the sliding rail assembly to cover the fixed bracket and the sliding rail assembly, and a sliding shelf including an article carrying surface on which an article will be placed, a coupling frame extending from the article carrying surface and removably coupled to the rail cover, and a wire arm having a pair of rotating shafts pivotally coupled to opposite sides of the coupling frame so as to be moved between a horizontally unfolded (lowered) position and a vertically folded (raised) position, wherein the wire arm extends from the pair of rotating shafts to extend along an edge of the article carrying surface at the upper side of the edge, and each of the pair of rotating shafts is provided with a stopper member to restrict a pivoting angle of the wire arm.

A length between front and rear ends of the rail cover may be less than a front-and-rear length of the storage compartment.

The rail cover may do not protrude outward from a front end of the storage compartment when the rail cover is withdrawn to the maximum extent.

The sliding unit may include a rolling member installed to the fixed bracket to support a lower portion of the rail cover in order to prevent the rail cover from sagging by external force applied to the rail cover.

The sliding rail assembly may include a rail fixing member to restrict movement of the sliding unit by coming into frictional contact with the fixed bracket when the sliding unit is pushed inward to the maximum extent, and a position control bump formed of an elastic material, the position control bump restricting the maximum withdrawal distance of the sliding unit by coming into contact with the fixed bracket when the sliding unit is withdrawn outward.

The sliding rail assembly may include a first rail to be moved along with the rail cover, a second rail coupled to the fixed bracket, and a third rail slidably coupled between the first rail and the second rail to extend the withdrawal distance of the first rail.

In accordance with another aspect, a refrigerator includes a main body having a storage compartment divided into upper and lower regions by an intermediate partition, the main body including an inner shell defining the storage compartment and an outer shell spaced apart from the inner shell with a thermal-insulating material interposed between the inner shell and the outer shell, a door to open or close the storage compartment, a first shelf removably mounted to a rear wall of the inner shell, a second shelf arranged parallel to the first shelf between the first shelf and a sidewall of the inner shell, the second shelf including an article carrying surface on which an article will be placed and a coupling frame extending from the article carrying surface, a sliding unit slidably coupled to the sidewall of the inner shell to allow the second shelf to be moved forward or rearward relative to the storage compartment while supporting one end of the second shelf, and a guide provided between the first shelf and the second shelf to support the other end of the second shelf when the second shelf is moved by the sliding unit, thereby guiding movement of the second shelf, wherein the sliding unit includes a fixed bracket coupled to the inner shell, a sliding rail assembly coupled to the fixed bracket, and a rail cover coupled to the sliding rail assembly to cover the fixed bracket and the sliding rail assembly, the rail cover being coupled to the coupling frame of the second shelf.

In accordance with another aspect, a refrigerator includes a main body having a storage compartment divided into upper and lower regions by an intermediate partition, the main body including an inner shell defining the storage compartment and an outer shell spaced apart from the inner shell with a thermal-insulating material interposed between the inner shell and the outer shell, a door to open or close the storage compartment, a first shelf removably mounted to a rear wall of the inner shell, a sliding unit slidably coupled to a sidewall of the inner shell to be movable forward or rearward relative to the storage compartment, a second shelf arranged parallel to the first shelf between the first shelf and the sidewall of the inner shell, the second shelf including an article carrying surface and a coupling frame extending from the article carrying surface and fitted into the sliding unit, and a guide provided between the first shelf and the second shelf to support the second shelf when the second shelf is moved by the sliding unit, thereby guiding movement of the second shelf.

In accordance with a further aspect, a refrigerator includes a main body having a storage compartment divided into upper and lower regions by an intermediate partition, the main body including an inner shell defining the storage compartment and an outer shell spaced apart from the inner shell with a thermal-insulating material interposed between the inner shell and the outer shell, a door to open or close the storage compartment, a first shelf removably mounted to a rear wall of the inner shell, a sliding unit slidably coupled to a sidewall of the inner shell to be movable forward or rearward relative to the storage compartment, a second shelf arranged parallel to the first shelf between the first shelf and the sidewall of the inner shell, the second shelf including an article carrying surface and a coupling frame extending orthogonal to the article carrying surface and coupled to the sliding unit, and a guide provided between the first shelf and the second shelf to support the second shelf when the second shelf is moved by the sliding unit, thereby guiding movement of the second shelf, wherein the coupling frame includes a wire arm vertically pivotally coupled thereto to prevent separation of an article, the wire arm extending along an edge of the article carrying surface at the upper side of the edge.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
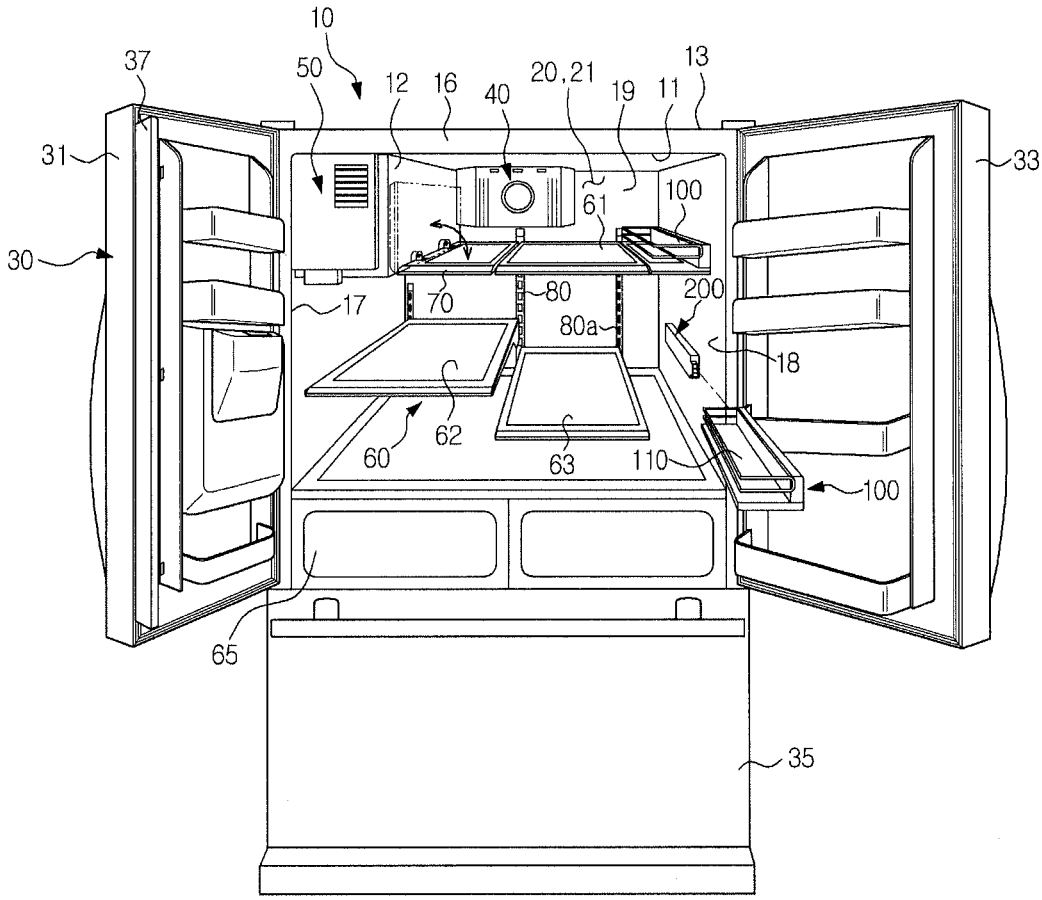
FIG. 1 is a perspective view illustrating an interior configuration of a refrigerator in accordance with an embodiment.

Reference will now be made in detail to the embodiments, examples of which are illustrated in the accompanying drawings, wherein like reference numerals refer to like elements throughout.

Figure 2:
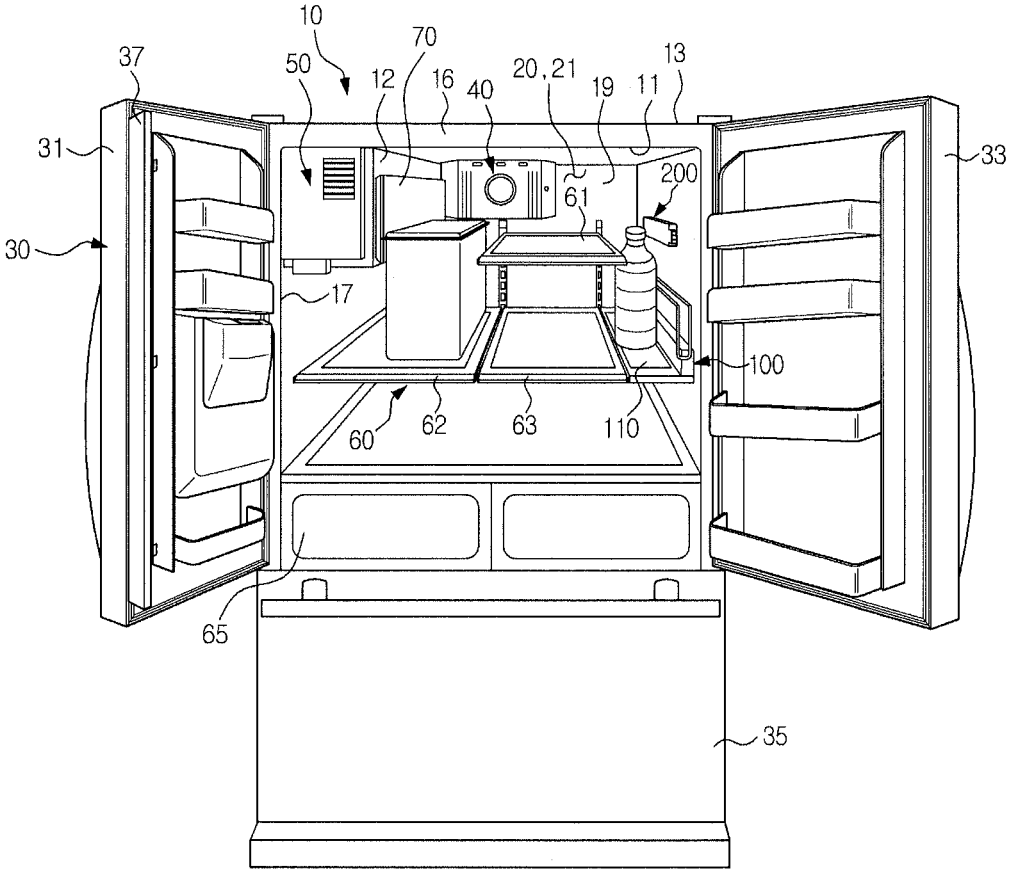
FIG. 2 is a perspective view illustrating the arrangement of shelves in a storage compartment in accordance with the embodiment.
Figure 3:
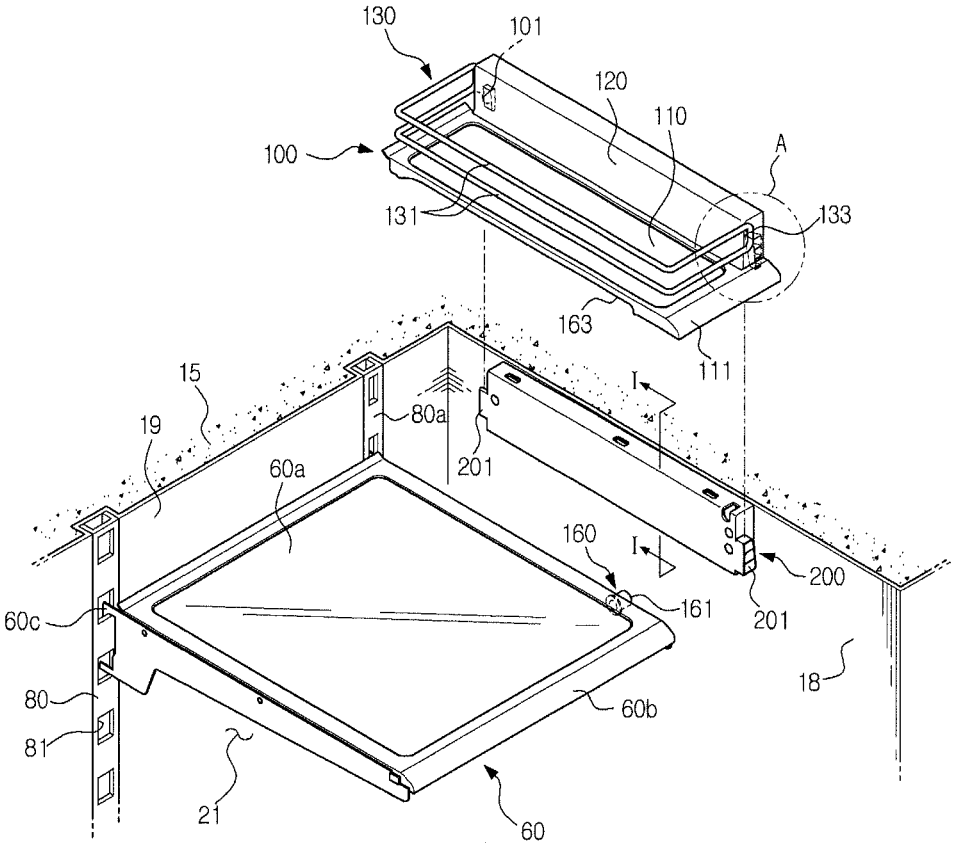
FIG. 3 is a perspective view illustrating the coupling relationship of a sliding shelf in accordance with the embodiment.
Figure 4:
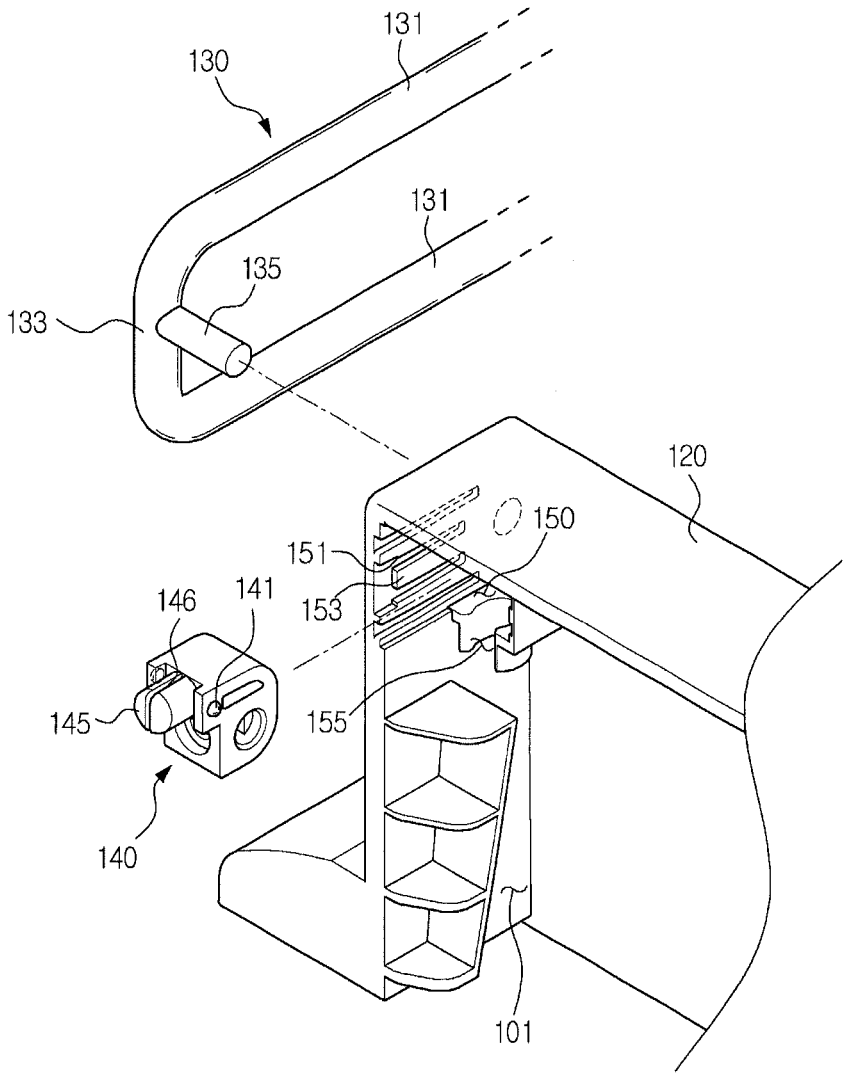
FIG. 4 is an exploded perspective view illustrating a rear surface of the portion 'A' of FIG. 3.

FIG. 1 is a perspective view illustrating an interior configuration of a refrigerator in accordance with an embodiment, FIG. 2 is a perspective view illustrating the arrangement of shelves in a storage compartment in accordance with the embodiment, FIG. 3 is a perspective view illustrating the coupling relationship of a sliding shelf in accordance with the embodiment, and FIG. 4 is an exploded perspective view illustrating a rear surface of the portion 'A' of FIG. 3.

Referring to FIGS. 1 to 3, the refrigerator of the embodiment may include a main body 10 in which a plurality of storage compartments 20 is defined and separated from each other, doors 30 provided at front sides of the plurality of storage compartments 20 to open or close the respective storage compartments 20, a cold-air supply device 40 placed in the storage compartments 20 to supply cold air into a respective one of the storage compartments 20, and a machine room (not shown) defined in a lower rear region of the main body 10 in which electric components, such as a compressor, for example, are installed.

In the present embodiment, the refrigerator employs a refrigeration cycle consisting of a compressor, condenser, expander, and evaporator, to produce cold air to be discharged via the cold-air supply device 40.

The main body 10 is constructed by an inner shell 11 and an outer shell 13, and a thermal-insulating material 15 in the form of a foam is filled between the inner shell 11 and the outer shell 13 to prevent transmission of heat. The outer appearance of the main body 10 is defined by a top wall 16, a bottom wall (not shown), a left wall 17, a right wall 18, and a rear wall 19. An intermediate partition is used to separate the storage compartments 20 from each other.

The storage compartments 20 may include an upper first storage compartment 21 and a lower second storage compartment (not shown), which are separated from each other by a horizontal intermediate partition. The first storage compartment 21 may serve as a refrigerating compartment that maintains a temperature slightly above freezing, and the second storage compartment (not shown) may serve as a freezing compartment that maintains a temperature at or below freezing.

The doors 30 are provided at front sides of the first storage compartment 21 and the second storage compartment (not shown) to open or close the respective storage compartments 20. The doors 30 may include a pair of pivoting doors 31 and 33, which are configured to pivot leftward or rightward so as to respectively open or close left and right regions of the first storage compartment 21, and a drawer type door 35 which is configured to perform sliding movement so as to open or close the second storage compartment.

The pair of pivoting doors 31 and 33 is hinged to left and right edges of the main body 10. The drawer type door 35 is slidably installed to the main body 10 to be pushed into or pulled out of the second storage compartment.

The first storage compartment 21 may have a relatively large storage space not divided by a thermal-insulating partition. A filler device 37 is provided between the pair of pivoting doors 31 and 33 to seal a gap between the doors 31 and 33.

An ice-making chamber is defined by a thermal-insulating wall 12 near an upper corner of one sidewall, i.e. the left wall 17 of the first storage compartment 21 so as to be isolated from the first storage compartment 21. An icemaker 50 to make ice may be accommodated within the ice-making chamber.

To ensure efficient utilization of the relatively large storage space of the first storage compartment 21, a plurality of shelves on which food, etc. will be placed may be arranged in an upper space of the first storage compartment 21 and a plurality of accommodation drawers 65 in which food, etc. will be accommodated is provided in a lower space of the first storage compartment 21.

The plurality of shelves may include a first shelf 60 and a second shelf 100, which are removably installed in the first storage compartment 21, and a third shelf 70 pivotally affixed to a vertical wall surface of the thermal-insulating wall 12, the third shelf 70 being of a foldable type.

The first shelf 60 may be of a cantilever type and be coupled to shelf support posts 80 attached to the rear wall 19 of the first storage compartment 21. The second shelf 100 may be of a sliding type and be installed to one sidewall of the first storage compartment 21, i.e. the right wall 18 so as to slide forward or rearward relative to the first storage compartment 21.

The first shelf 60 and the second shelf 100 may effectively divide the first storage compartment 21 having a relatively large storage space according to an arrangement relationship therebetween. More specifically, three shelf support posts 80, to which the first shelf 60 is coupled, may be arranged at a center position and opposite lateral positions of the rear wall 19 of the first storage compartment 21. Each of the shelf support posts 80 has a plurality of shelf hanger recesses 81 vertically spaced apart from one another to enable adjustment in the height of the first shelf 60.

As illustrated in FIG. 1, a rightmost one of the three shelf support posts, i.e. a shelf support post 80*a* is spaced apart from the right wall 18 of the first storage compartment 21 by a predetermined distance, such that a space for installation of the second shelf 100 is defined between the right wall 18 and the shelf support 80*a*.

The first shelf 60 may include an article carrying surface 60*a* made of reinforced glass, on which food will be placed, and a frame 60*b* configured to surround the periphery of the article carrying surface 60*a*. Additionally, the first shelf 60 may be provided at opposite rear corners thereof with hooks 60*c*, which are configured to be caught and supported by the shelf hanger recesses 81. A plurality of first shelves 60 having different widths may be provided, such that neighboring shelves are horizontally aligned in parallel or have a height difference according to sizes of articles to be stored.

In one example, considering a configuration of shelves in an uppermost layer of the first storage compartment 21 illustrated in FIG. 1, the foldable shelf 70 may be pivotally coupled at one end thereof to the thermal-insulating wall 12, a cantilever shelf 61, which is caught and supported by the shelf support posts 80, may be located at the right of the foldable shelf 70 and in turn, the second shelf 100, which is slidable forward or rearward relative to the first storage compartment 21, may be located between the cantilever shelf 61 and the right wall 18 of the first storage compartment 21 so as to be horizontally aligned parallel to the cantilever shelf 61.

In this case, two cantilever shelves 62 and 63 and a single sliding shelf 100 may be arranged parallel to one another immediately below the shelves of the uppermost layer. With this configuration, as illustrated in FIG. 2, in a vertically folded (raised) position of the foldable shelf 70, e.g., a tall article may be placed on the first shelf 62 below the foldable shelf 70. A space for storage of such a tall article may be provided even when the sliding shelf 100 is removed. As such, an available volume of the storage space may be increased as a user appropriately arranges the first shelf 60, the second shelf 100 and the third shelf 70 in order to store desired articles at appropriate positions. That is, in the present embodiment, the cantilever type first shelf 60 and the sliding type second shelf 100 are removably installed in the first storage compartment 21, which allows the storage space of the first storage compartment 21 to be appropriately divided as necessary.

The second shelf 100, as illustrated in FIG. 3, may have a smaller article carrying surface 110 than the article carrying surface 60*a* of the first shelf 60 affixed to the rear wall 19 of the first storage compartment 21, to have a size suitable for carrying relatively small articles, such as sauce pots, for example.

The second shelf 100 may be removably coupled to a sliding unit 200 which is in turn coupled to the rear wall 18 of the first storage compartment 21 so as to slide forward or rearward relative to the first storage compartment 21, which may increase the withdrawal distance of the second shelf 100.

To this end, the sliding unit 200 may be provided at front and rear ends thereof with a pair of outwardly protruding fitting portions 201 and the second shelf 100 may be provided with a pair of indented fitting regions 101 corresponding to the pair of fitting portions 201.

Figure 5:
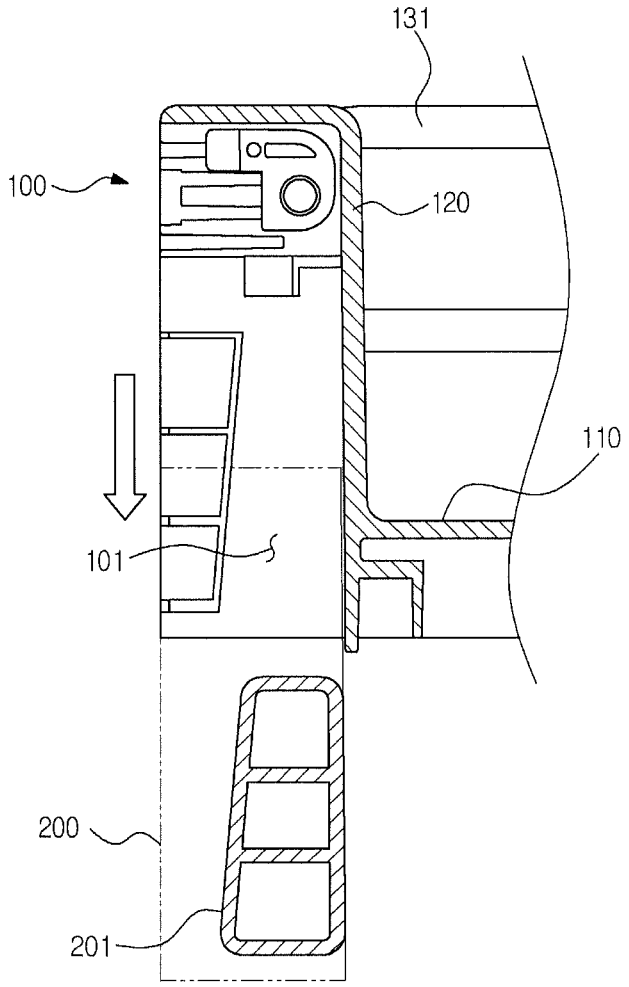
FIG. 5 is a view illustrating a coupling configuration of the sliding shelf and a rail cover in accordance with the embodiment.

As the second shelf 100 is moved downward from above the sliding unit 200 for removal and mounting convenience as illustrated in FIG. 5, the fitting portions 201 of the sliding unit 200 are interference-fitted into the indented fitting regions 101 of the second shelf 100, whereby the second shelf 100 is firmly coupled to the sliding unit 200. Then, if the second shelf 100 is pulled upward upon receiving certain external force, the second shelf 100 is removed from the sliding unit 200.

The second shelf 100 may include the article carrying surface 110 made of reinforced glass, on which an article will be placed, and a resin frame 111 configured to surround the periphery of the article carrying surface 110. An upwardly protruding coupling frame 120 may be provided at an end portion of the frame 111, i.e. at a right edge of the frame 111 in the drawing.

The coupling frame 120 is a component to be coupled to the sliding unit 200 installed to the right wall 18 of the first storage compartment 21. The pair of indented fitting regions 101 as described above is defined respectively in inner longitudinal end portions of the coupling frame 120. In addition, the coupling frame 120 may be provided with a wire arm 130, which is vertically pivotally coupled to the coupling frame 120 to prevent an article placed on the article carrying surface 110 of the second shelf 100 from falling.

Referring to FIGS. 3 and 4, the wire arm 130 may include a pair of horizontal portions, which are vertically spaced apart from each other and are bent to conform to the periphery of the second shelf 100, and a pair of vertical portions 133, which connect opposing distal ends of the pair of horizontal portions 131 to each other. A pair of rotating shafts 135 may be formed respectively at the pair of vertical portions 133 to extend inward and be pivotally coupled to the coupling frame 120.

The wire arm 130 may be coupled to the coupling frame 120 so as to pivot between a horizontally unfolded (lowered) position where the wire arm 130 serves to prevent the article placed on the article carrying surface 110 from falling or escaping from the second shelf 100 and a vertically folded (raised) position where the wire arm 130 serves to allow the article carrying surface 110 to provide an expanded article carrying area in conjunction with the article carrying surface 60*a* of the first shelf 60.

Figure 8:
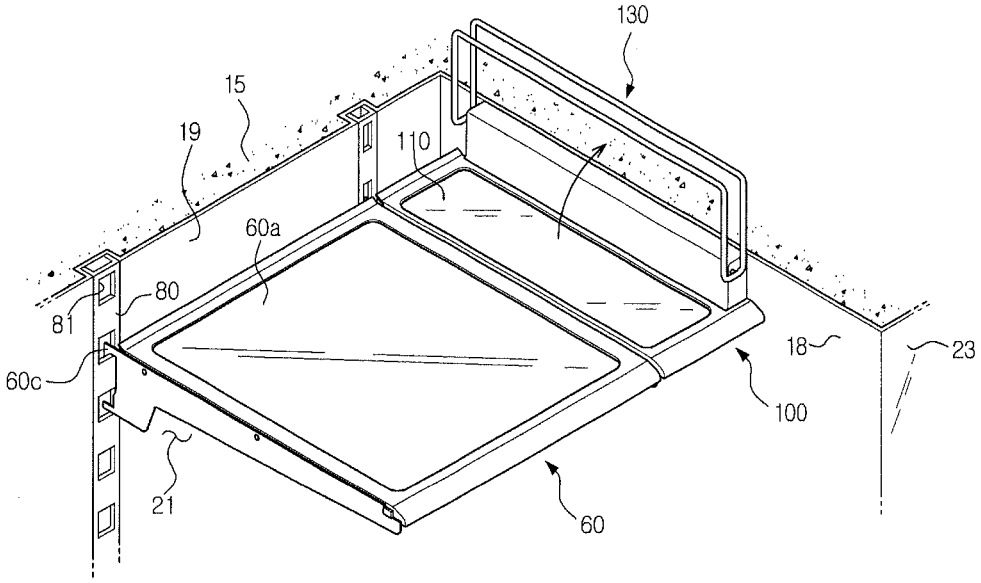
FIG. 8 is a perspective view illustrating an inserted state of the sliding shelf in accordance with the embodiment.

As illustrated in FIG. 8, if the wire arm 130 is vertically folded (raised) in a state in which the article carrying surface 60*a* of the first shelf 60 and the article carrying surface 110 of the second shelf 100 are arranged at substantially the same height, the article carrying surfaces 60*a* and 110 provide an expanded surface area to carry articles.

Additionally, a stopper member 140 may be provided at a respective one of the rotating shafts 135 of the wire arm 130 vertically pivotally coupled to the coupling frame 120. The stopper member 140 may serve to limit a pivoting angle of the wire arm 130.

The stopper member 140 is coupled to the corresponding rotating shaft 135 of the wire arm 130 and is accommodated in a stopper receptacle 150 provided at inner longitudinal end regions of the coupling frame 120 so as to rotate simultaneously with pivoting of the wire arm 130. The stopper member 140 is provided at opposite sides thereof with stopper bosses 141 to restrict pivoting of the wire arm 130 within a predetermined pivoting angle. The stopper bosses 141 are caught by stopper grooves 151 formed in opposite sidewalls of the stopper receptacle 150, thereby preventing the wire arm 130 from pivoting downward.

The plurality of stopper grooves 151 is constructed by a plurality of guide ribs 153, which protrude from the sidewalls of the stopper receptacle 150 so as to be vertically spaced apart from one another. The plurality of stopper bosses 141 is alternately caught and supported by the plurality of stopper grooves 151 according to a pivoting angle of the wire arm 130.

Figure 6:
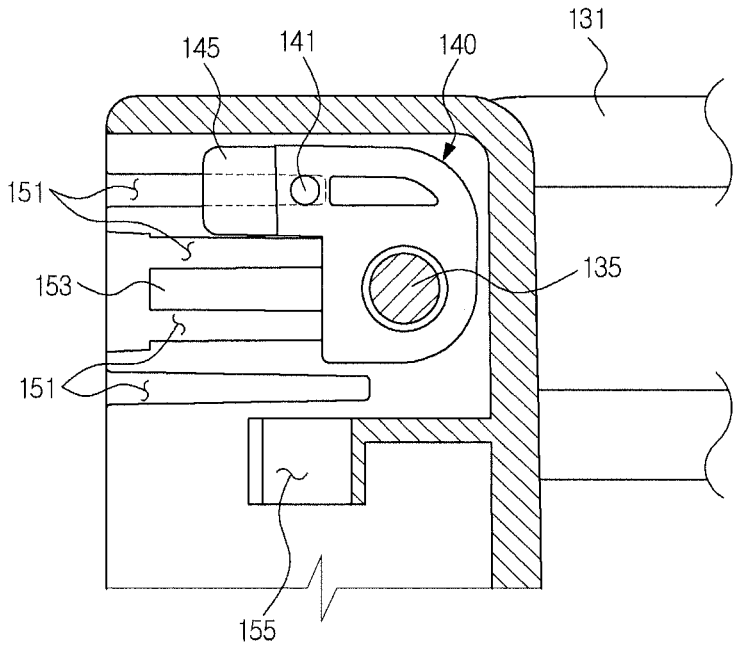
FIG. 6 is a view illustrating a coupling relationship of an unfolded (lowered) state of a wire arm in accordance with the embodiment.
Figure 7:
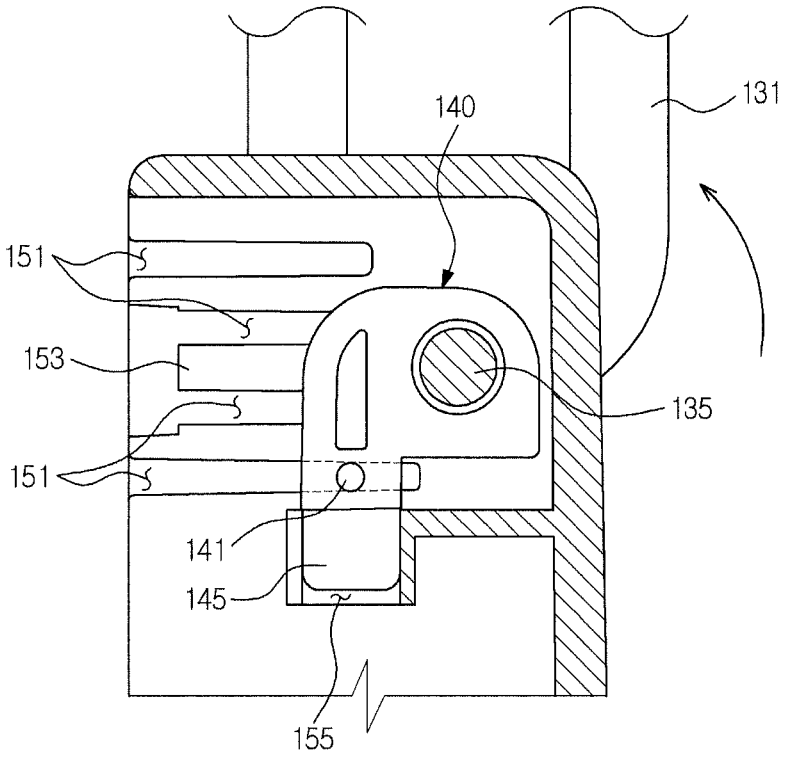
FIG. 7 is a view illustrating a coupling relationship of a folded (raised) state of the wire arm in accordance with the embodiment.

In addition to the stopper grooves 151, a restraint bore 155 is provided at the bottom of the stopper receptacle 150 to restrain pivoting of the wire arm 130 in the vertically folded (raised) state of the wire arm 130. A press-fit rod 145 of the stopper member 140 is interference-fitted into the restraint bore 155, thereby restraining pivoting of the vertically folded (raised) wire arm 130. More specifically, in a state in which the wire arm 130 is horizontally unfolded (lowered) as illustrated in FIG. 3, the stopper bosses 141 of the stopper member 140 are caught and supported by uppermost ones of the stopper grooves 151 provided at the sidewalls of the stopper receptacle 150 as illustrated in FIG. 6, thereby restraining upward pivoting of the wire arm 130. Then, if the user applies upward force to the wire arm 130 to pivot the wire arm 130, the stopper bosses 141 are shifted to lowermost ones of the stopper grooves 151 by way of the other multistage stopper grooves 151 as illustrated in FIG. 7, thereby causing the wire arm 130 to be vertically folded (raised) and the press-fit rod 145 of the stopper member 140 to be interference-fitted into the restraint bore 155. In this case, to ensure elastic deformation of the press-fit rod 145 interference-fitted into the restraint bore 155, the press-fit rod 145 may be provided at a central portion thereof with a slot 146.

Figure 9:
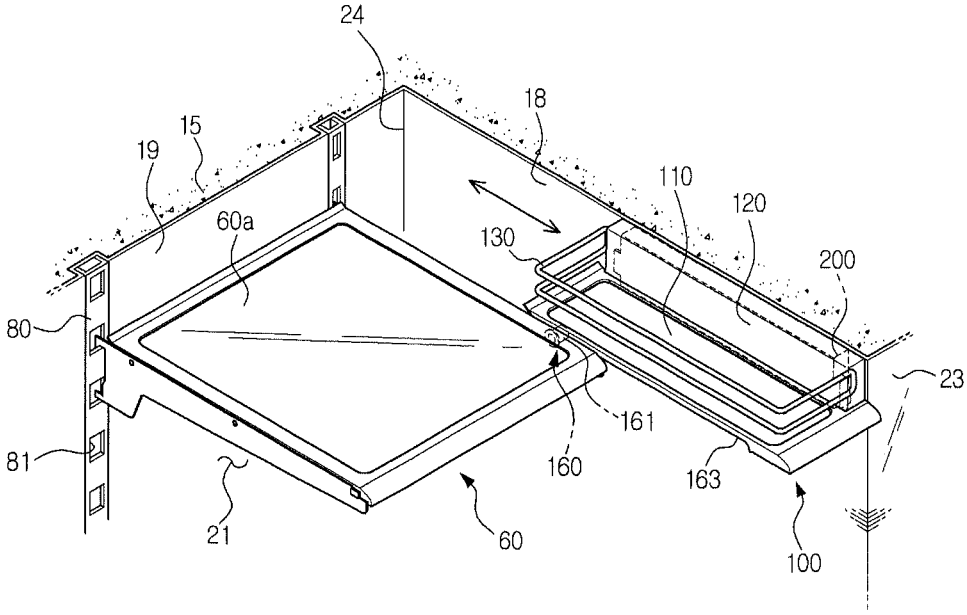
FIG. 9 is a perspective view illustrating a withdrawn state of the sliding shelf in accordance with the embodiment.

Once the second shelf 100 has been coupled to the sliding unit 200 which is slidable on the right wall 18 of the first storage compartment 21 as illustrated in FIG. 3, the second shelf 100 is slidable forward or rearward relative to the first storage compartment 21 as illustrated in FIG. 9.

When realizing movement of the second shelf 100 via the sliding unit 200, the second shelf 100 may be easily operated even by low manual force and be smoothly moved even if articles are loaded on the second self 100, which results in remarkably enhanced movement qualities.

Additionally, when the second shelf 100 slides on the right wall 18 of the first storage compartment 21 via the sliding unit 200, a lateral surface of the second shelf 100 opposite to the coupling frame 120 may be movably supported on a guide 160 provided at the first shelf 60.

The guide 160 serves not only to stably guide the second shelf 100 while the second shelf 100 is moved by the sliding unit 200, but also to reduce sagging of the second shelf 100 caused by the weight of articles placed on the article carrying surface 110 of the second shelf 100 even after the second shelf 100 is withdrawn by an increased distance.

The guide 160 includes a roller member 161 rotatably provided at a lateral surface of the first shelf 60. When the second shelf 100 is coupled to the sliding unit 200, the roller member 161 may come into rolling contact with a roller support groove 163 indented in the lateral surface of the second shelf 100. Of course, although the sliding unit 200 sufficiently supports the second shelf 100 to ensure that the second shelf 100 is smoothly movable while overcoming load applied thereto, provision of the roller member 161 as an additional support member enables more stable and smooth movement of the second shelf 100 even if the withdrawal distance of the second shelf 100 is increased.

The sliding unit 200, which movably supports the second shelf 100, may have a length less than a front-and-rear length of the first storage compartment 21 as illustrated in FIG. 9, and opposite front and rear ends of the sliding unit 200 may be moved between a front end 23 and a rear end 24 of the first storage compartment 21. This configuration serves to prevent the sliding unit 200 from protruding beyond the front end 23 of the second storage compartment 23, thereby preventing any possible deterioration in the aesthetic outer appearance due to the exposure of the sliding unit 200. The sliding unit 200 may be preassembled into a single unit and thereafter, be coupled to the rear wall 18 of the first storage compartment 21.

To ensure stable movement of the second shelf 100 and prevent sagging of the second shelf 100 even if the withdrawal distance of the second shelf 100 is increased, the sliding unit 200 may include a sliding rail structure for movement of the second shelf 100.

Figure 10:
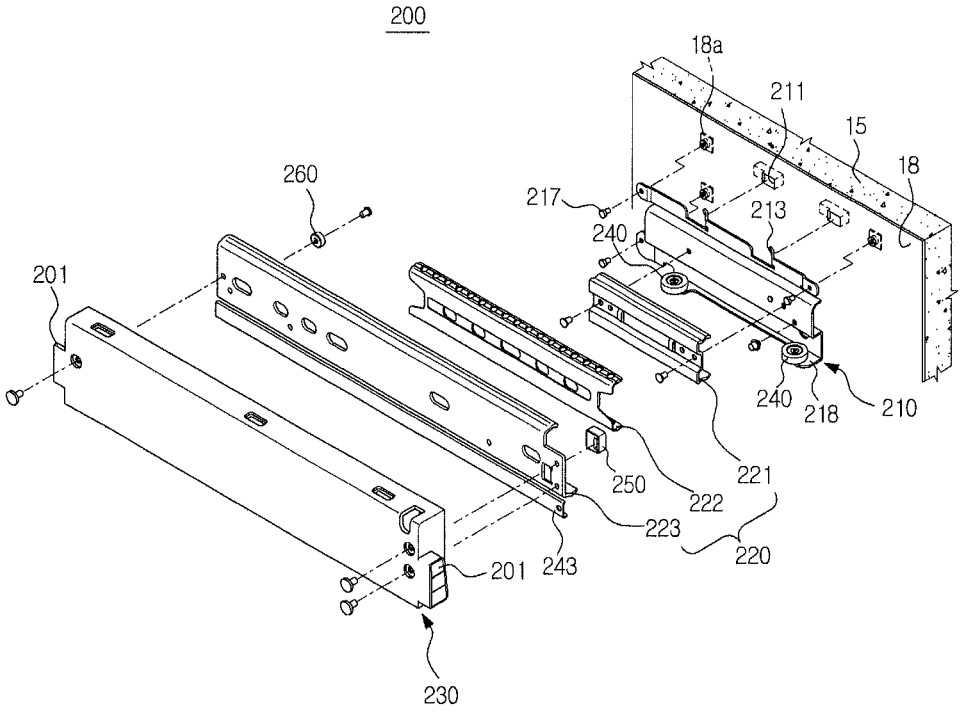
FIG. 10 is an exploded perspective view of a sliding unit in accordance with the embodiment.
Figure 11:
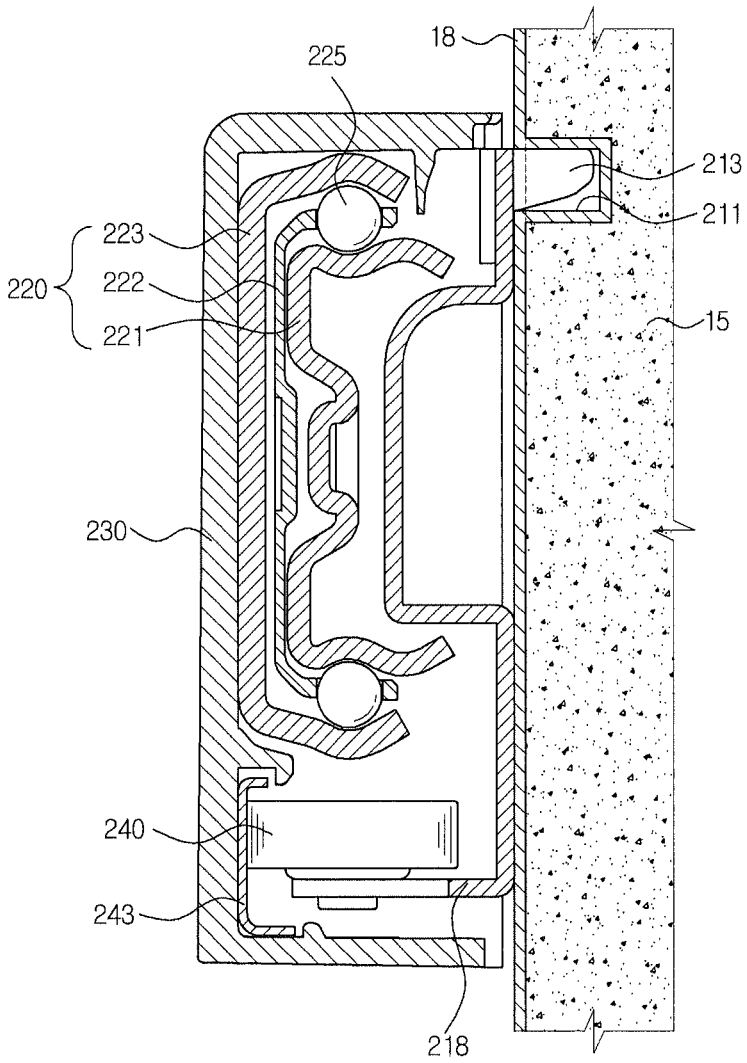
FIG. 11 is a sectional view of the sliding unit taken along the line I-I of FIG. 3.

FIG. 10 is an exploded perspective view of the sliding unit in accordance with the embodiment, and FIG. 11 is a sectional view of the sliding unit taken along the line I-I of FIG. 3.

Referring to FIGS. 10 and 11, the sliding unit 200 may include a fixed bracket 210 affixed to the rear wall 18 of the first storage compartment 21, a sliding rail assembly 220 coupled to the fixed bracket 210, and a rail cover 230 coupled to the sliding rail assembly 220 to cover the fixed bracket 210 and the sliding rail assembly 220.

The fixed bracket 210 is formed of a metal plate having a predetermined bent shape to exhibit rigidity required to support the sliding rail assembly 220 and is affixed to the rear wall 18 of the first storage compartment 21. The rear wall 18 of the first storage compartment 21 may be provided with a pair of positioning recesses 211 to determine an installation position of the fixed bracket 210 and correspondingly, the fixed bracket 210 may be provided with a pair of positioning pins 213 to be inserted into the positioning recesses 211. After the positioning pins 213 are inserted into the positioning recesses 211, the fixed bracket 210 is fastened to the rear wall 18 using screws 217. Reinforcing members 18*a* may be embedded in the rear wall 18 and serve to increase rigidity of a wall surface supporting the fixed bracket 210 so as to prevent the fixed bracket 210 from sagging by external force applied to the fixed bracket 210.

The sliding rail assembly 220 to enable sliding movement of the second shelf 100 may be coupled to the fixed bracket 210. The sliding rail assembly 220 may have a triple rail configuration to increase the withdrawal distance of the second shelf 100.

The sliding rail assembly 220 may include a first rail 221 fixedly coupled to the fixed bracket 210, a second rail 222 slidably coupled to the first rail 221, and a third rail 223 movably coupled to the second rail 220 while being secured to the rail cover 230.

The first rail 221 fixedly coupled to the fixed bracket 210 serves to support the sliding rail assembly 220 and has bent upper and lower distal portions to define an approximately "U"-shaped form. The second rail 222 is interposed between the first rail 221 and the third rail 223 and is slidable relative to both the rails 221 and 223. The third rail 223 has a length greater than that of the second rail 213 to cover the entire second rail 222 and is movable relative to the second rail 222.

The third rail 223 has a length corresponding to a front-and-rear length of the rail cover 230 and is secured to the rail cover 230 so as to move along with the rail cover 230.

Although the front-and-rear length of the third rail 223 is less than the front-and-rear length of the first storage compartment 21, the third rail 223 is movable throughout a range between the front end and the rear end of the first storage compartment 21 because the second rail 222 functions to extend the withdrawal distance of the third rail 223. The second rail 222 may be longer than the first rail 221, but shorter than the third rail 223.

Ball members 225 may be provided between the first rail 222, the second rail 222, and the third rail 223 to ensure stable relative movement between these rails 221, 222, and 223.

The rail cover 230 functions to connect the sliding shelf, i.e. the second shelf 100 and the sliding rail assembly 220 to each other and to prevent the sliding rail assembly 220 from being exposed to the outside.

With this configuration, the sliding unit 200 may increase the withdrawal distance of the second shelf 100 by sliding forward or rearward on the rear wall 18 of the first storage compartment 21, and the sliding rail assembly 220 moving on the rear wall 18 of the first storage compartment 21 is hidden within the first storage compartment 21 to achieve further enhancement in aesthetics.

In this way, even if the sliding unit 200 is moved to the front end of the first storage compartment 21 by the sliding rail assembly 220 of a triple rail type as illustrated in FIGS. 8 and 9, the sliding unit 200 may provide the rear wall 18 of the first storage compartment 21 with a smart outer appearance without exposure of the rail structure, which increases user satisfaction.

The sliding unit 200 may further include a rail fixing member 250 to restrict movement of the sliding rail assembly 220 when the sliding unit 200 reaches the rear end of the first storage compartment 21.

Figure 12:
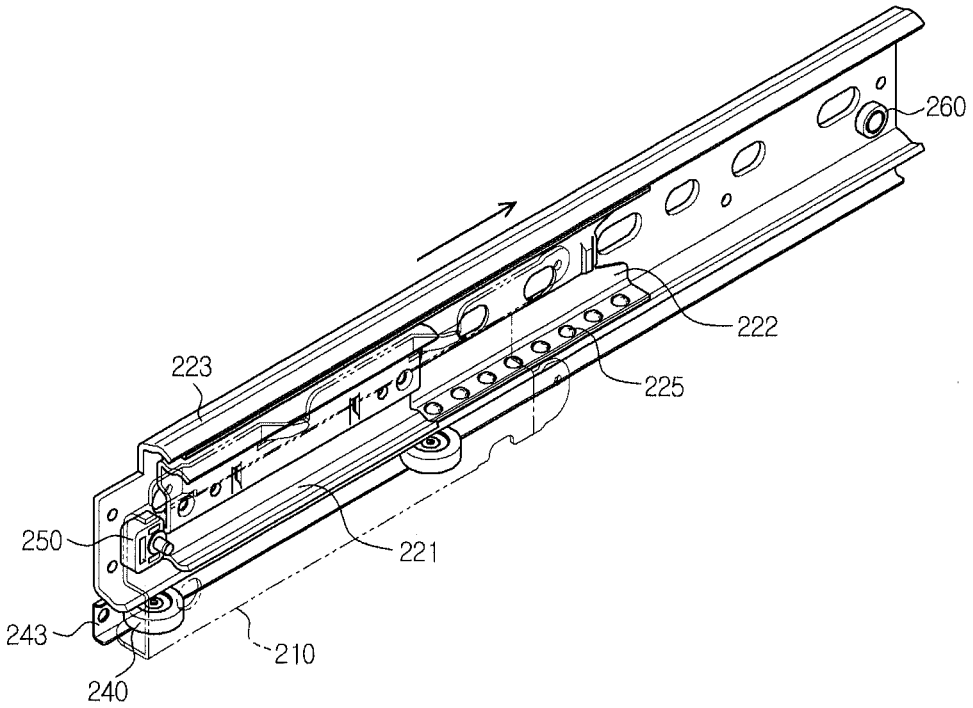
FIG. 12 is a view illustrating an operational mode in which the sliding rail assembly of the embodiment is inserted.

The rail fixing member 250 is formed of an elastic material and is fixed at a position near a front end of the third rail 223. When the second shelf 100 is located at an original position in the first storage compartment 21 as illustrated in FIG. 8, the rail fixing member 250 comes into frictional contact with an outer surface of the fixed bracket 210 as illustrated in FIG. 12, thereby restricting movement of the third rail 223 by friction.

In this case, if the user pulls the second shelf 100 out by applying certain external force, the rail fixing member 250 is separated from the fixed bracket 210, thereby causing the third rail 223 to be withdrawn forward.

To limit the maximum withdrawal distance of the third rail 223 and reduce impact caused in the maximum withdrawn state of the third rail 223 when the sliding unit 220 is moved to the front end of the first storage compartment 21, the sliding unit 220 may further include an elastic position control bump 260 to come into contact with the sliding rail assembly 220 or the fixed bracket 210.

Figure 13:
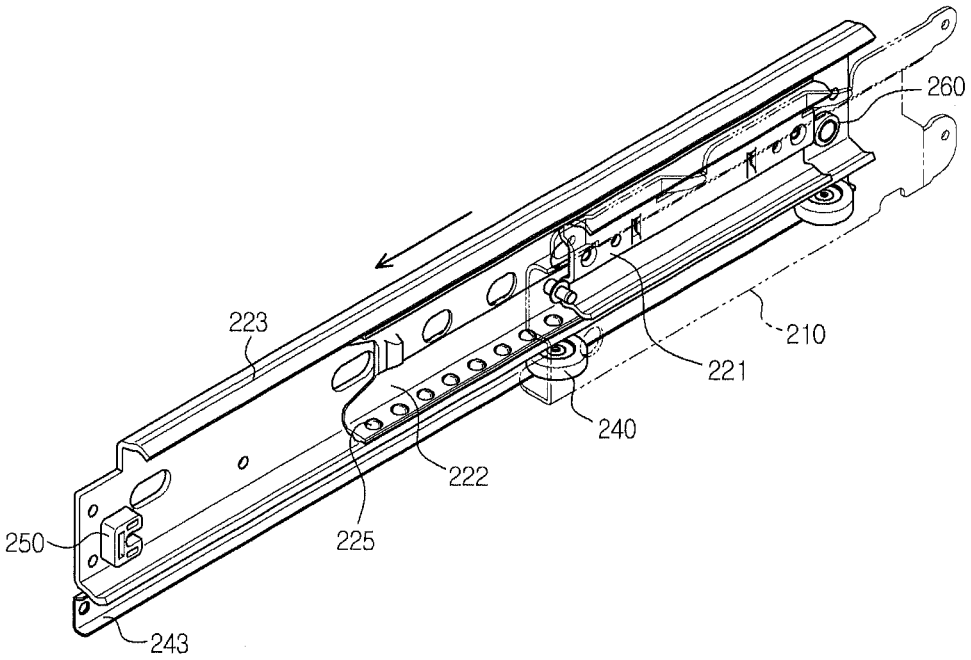
FIG. 13 is a view illustrating an operational mode in which the sliding rail assembly of the embodiment is withdrawn.

The position control bump 260 is formed of an elastic material, such as rubber, for example, and is fixed at a position near the rear end of the third rail 223. When the second shelf 100 is withdrawn to near the front end of the first storage compartment 21 as illustrated in FIG. 9, the position control bump 260 comes into frictional contact with a corresponding end of the first rail 221 coupled to the fixed bracket 210 as illustrated in FIG. 13, thereby restricting the withdrawal distance of the third rail 223 and preventing damage due to collision.

Additionally, a pair of rolling members 240 may be provided at the fixed bracket 210 and serve to prevent the rail cover 230 from sagging by the weight of articles placed on the second shelf 100.

The rolling member 240 includes a roller installed to rotate on a horizontal support plane 218 provided by a bent lower end of the fixed bracket 210, and an outer periphery of the roller comes into contact with an inner surface of a lower portion of the rail cover 230.

The rail cover 230 may be provided at the inner surface thereof with a reinforcing frame 243, which serves to prevent abrasion during rolling contact with the rolling member 240 and increase rigidity of a contact surface of the rail cover 230 coming into contact with the rolling member 240.

As is apparent from the above description, the embodiment provides a refrigerator having a sliding rail assembly of a triple rail type, which provides an increased withdrawal distance of a shelf, resulting in enhanced convenience.

In the refrigerator according to the embodiment, a fixed shelf and a sliding shelf may define a common article carrying surface, which enables effective utilization of a storage space of a storage compartment.

In the refrigerator according to the embodiment, as the shelf is installed to be smoothly pushed into or pulled out of the storage compartment, a user may achieve enhanced quality.

In the refrigerator according to the embodiment, a more aesthetically pleasing outer appearance may be realized because the sliding rail assembly is hidden by a rail cover so as not to be exposed to the outside and also, enhanced convenience may be accomplished by minimizing interference between a door and the shelf upon opening/closing of the door via calculation of an appropriate withdrawal distance of the shelf.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body having a storage compartment divided into upper and lower regions by an intermediate partition, the main body including an inner shell defining the storage compartment and an outer shell spaced apart from the inner shell with a thermal-insulating material interposed between the inner and outer shell;

a door to open or close the storage compartment;

a first shelf removably mounted to a rear wall of the inner shell in a height adjustable manner;

a second shelf horizontally aligned with the first shelf between the first shelf and a sidewall of the inner shell, and comprising a wire arm having a pair of rotating shafts pivotally coupled to be moved between a horizontally unfolded (lowered) position and a vertically folded (raised) position and rotating along an axis allowing the second shelf to expand a surface area of the first shelf when the wire arm is in the vertically folded (raised) position; and a sliding unit to move the second shelf forward or rearward relative to the storage compartment, wherein the sliding unit includes a sliding rail assembly slidably installed to the sidewall of the inner shell, and a rail cover coupled to the second shelf and configured to cover the sliding rail assembly to prevent exposure of the sliding rail assembly.

2. The refrigerator according to claim 1, further comprising a guide provided between the first shelf and the second shelf to support one end of the second shelf when the second shelf is moved while being supported at the other end thereof by the sliding unit, thereby guiding movement of the second shelf.

3. The refrigerator according to claim 2, wherein the guide includes a roller member installed to a lateral surface of the first shelf, and a roller support recess is formed in a lateral surface of the second shelf so as to come into contact with the roller member.

4. The refrigerator according to claim 1, wherein the sliding unit has a length less than a front-and-rear length of the storage compartment and is moved between a front end and a rear end of the storage compartment.

5. The refrigerator according to claim 1, wherein the second shelf includes an article carrying surface on which an article will be placed, and a coupling frame extending orthogonal to the article carrying surface and coupled to the rail cover.

6. The refrigerator according to claim 5, wherein the sliding unit further includes a fixed bracket coupled to the inner shell to support the sliding rail assembly, and wherein the rail cover is coupled to the sliding rail assembly to be moved along with the sliding rail assembly.

7. The refrigerator according to claim 6, wherein the sliding rail assembly includes a rail fixing member to come into contact with the fixed bracket at a maximally inserted position of the second shelf, thereby restricting movement of the sliding unit by friction.

8. The refrigerator according to claim 6, wherein the sliding rail assembly includes a first rail secured to the fixed bracket, a second rail slidably coupled to the first rail and having a length greater than that of the first rail, and a third rail secured to the rail cover to be moved relative to the second rail and having a length greater than that of the second rail.

9. The refrigerator according to claim 8, wherein ball members are provided between the first rail, the second rail, and the third rail.

10. The refrigerator according to claim 6, wherein the sliding rail assembly includes a position control bump formed of an elastic material, the position control bump coming into contact with the sliding rail assembly to restrict the maximum withdrawal distance of the second shelf when the second shelf is withdrawn.

11. The refrigerator according to claim 6, wherein the fixed bracket includes a rolling member to support a lower portion of the rail cover in order to guide smooth movement of the rail cover and prevent the rail cover from sagging by external force applied to the rail cover.

12. The refrigerator according to claim 5, wherein the coupling frame includes the wire arm vertically pivotally coupled thereto to prevent separation of an article, the wire arm extending along an edge of the article carrying surface at the upper side of the edge.

13. The refrigerator according to claim 12, wherein the wire arm includes a pair of horizontal portions vertically spaced apart from each other and having a bent shape corresponding to the periphery of the second shelf, a pair of vertical portions connecting opposite distal ends of the pair of horizontal portions to each other, and a pair of rotating shafts extending from the pair of vertical portions and coupled to the coupling frame, and wherein each of the pair of rotating shafts is provided with a stopper member to restrict a pivoting angle of the wire arm.

14. The refrigerator according to claim 1, wherein the second shelf is removable from the rail cover, the rail cover is provided at opposite sides thereof with a pair of fitting portions to allow the second shelf to be coupled to the rail cover when the second shelf is moved downward from above the rail cover, and the coupling frame is provided with a pair of indented fitting regions corresponding to the pair of fitting portions.

15. A refrigerator comprising:

a main body having a storage compartment divided into upper and lower regions by an intermediate partition, the main body including an inner shell defining the storage compartment and an outer shell spaced apart from the inner shell with a thermal-insulating material interposed between the inner and outer shell;

a door to open or close the storage compartment;

a first shelf removably mounted to a rear wall of the inner shell in a height adjustable manner;

a second shelf horizontally aligned with the first shelf between the first shelf and a sidewall of the inner shell; and a sliding unit to move the second shelf forward or rearward relative to the storage compartment, wherein the sliding unit includes a sliding rail assembly slidably installed to the sidewall of the inner shell, and a rail cover coupled to the second shelf and configured to cover the sliding rail assembly to prevent exposure of the sliding rail assembly, wherein the second shelf includes an article carrying surface on which an article will be placed, and a coupling frame extending orthogonal to the article carrying surface and coupled to the rail cover, wherein the coupling frame includes a wire arm vertically pivotally coupled thereto to prevent separation of an article, the wire arm extending along an edge of the article carrying surface at the upper side of the edge wherein the wire arm includes a pair of horizontal portions vertically spaced apart from each other and having a bent shape corresponding to the periphery of the second shelf, a pair of vertical portions connecting opposite distal ends of the pair of horizontal portions to each other, and a pair of rotating shafts extending from the pair of vertical portions and coupled to the coupling frame, wherein each of the pair of rotating shafts is provided with a stopper member to restrict a pivoting angle of the wire arm, and wherein the coupling frame includes a stopper receptacle configured to accommodate the stopper member, the stopper receptacle having a plurality of stopper grooves vertically spaced apart from each other, and wherein the stopper member includes a stopper boss to be caught by a corresponding one of the plurality of stopper grooves according to the pivoting angle of the wire arm.

16. The refrigerator according to claim 15, wherein the stopper receptacle includes a restraint bore to restrain pivoting of the wire arm in a vertically folded (raised) state of the wire arm, and the stopper member includes a press-fit rod to be press-fitted into the restraint bore in the vertically folded (raised) state of the wire arm.

17. A refrigerator comprising:

a main body including an inner shell defining a storage compartment, an outer shell spaced apart from the inner shell, and a thermal-insulating material interposed between the inner shell and the outer shell;

a door coupled to the main body to open or close the storage compartment;

a sliding unit including a fixed bracket secured to a sidewall of the inner shell to slide forward or rearward relative to the storage compartment, a sliding rail assembly coupled to the fixed bracket, and a rail cover coupled to the sliding rail assembly to cover the fixed bracket and the sliding rail assembly; and a sliding shelf including an article carrying surface on which an article will be placed, a coupling frame extending from the article carrying surface and removably coupled to the rail cover, and a wire arm having a pair of rotating shafts pivotally coupled to opposite sides of the coupling frame to be moved between a horizontally unfolded (lowered) position and a vertically folded (raised) position and rotating along an axis allowing the sliding shelf to expand a surface area of another shelf when the wire arm is in the vertically folded (raised) position, wherein the wire arm extends from the pair of rotating shafts to extend along an edge of the article carrying surface at the upper side of the edge, and each of the pair of rotating shafts is provided with a stopper member to restrict a pivoting angle of the wire arm.

18. The refrigerator according to claim 17, wherein a length between front and rear ends of the rail cover is less than a front-and-rear length of the storage compartment.

19. The refrigerator according to claim 18, wherein the rail cover does not protrude outward from a front end of the storage compartment when the rail cover is withdrawn to the maximum extent.

20. The refrigerator according to claim 17, wherein the sliding unit includes a rolling member installed to the fixed bracket to support a lower portion of the rail cover in order to prevent the rail cover from sagging by external force applied to the rail cover.

21. The refrigerator according to claim 17, wherein the sliding rail assembly includes a rail fixing member to restrict movement of the sliding unit by coming into frictional contact with the fixed bracket when the sliding unit is pushed inward to the maximum extent, and a position control bump formed of an elastic material, the position control bump restricting the maximum withdrawal distance of the sliding unit by coming into contact with the fixed bracket when the sliding unit is withdrawn outward.

22. The refrigerator according to claim 17, wherein the sliding rail assembly includes a first rail to be moved along with the rail cover, a second rail coupled to the fixed bracket, and a third rail slidably coupled between the first rail and the second rail to extend the withdrawal distance of the first rail.

23. A refrigerator comprising:

a main body having a storage compartment divided into upper and lower regions by an intermediate partition, the main body including an inner shell defining the storage compartment and an outer shell spaced apart from the inner shell with a thermal-insulating material interposed between the inner shell and the outer shell;

a door to open or close the storage compartment;

a first shelf removably mounted to a rear wall of the inner shell;

a second shelf arranged parallel to the first shelf between the first shelf and a sidewall of the inner shell, the second shelf including an article carrying surface on which an article will be placed and a coupling frame extending from the article carrying surface, and comprising a wire arm having a pair of rotating shafts pivotally coupled to be moved between a horizontally unfolded (lowered) position and a vertically folded (raised) position and rotating along an axis allowing the second shelf to expand a surface area of the first shelf when the wire arm is in the vertically folded (raised) position;

a sliding unit slidably coupled to the sidewall of the inner shell to allow the second shelf to be moved forward or rearward relative to the storage compartment while supporting one end of the second shelf; and a guide provided between the first shelf and the second shelf to support the other end of the second shelf when the second shelf is moved by the sliding unit, thereby guiding movement of the second shelf, wherein the sliding unit includes a fixed bracket coupled to the inner shell, a sliding rail assembly coupled to the fixed bracket, and a rail cover coupled to the sliding rail assembly to cover the fixed bracket and the sliding rail assembly, the rail cover being coupled to the coupling frame of the second shelf.

24. A refrigerator comprising:

a main body having a storage compartment divided into upper and lower regions by an intermediate partition, the main body including an inner shell defining the storage compartment and an outer shell spaced apart from the inner shell with a thermal-insulating material interposed between the inner shell and the outer shell;

a door to open or close the storage compartment;

a first shelf removably mounted to a rear wall of the inner shell;

a sliding unit slidably coupled to a sidewall of the inner shell to be movable forward or rearward relative to the storage compartment;

a second shelf arranged parallel to the first shelf between the first shelf and the sidewall of the inner shell, the second shelf including an article carrying surface and a coupling frame extending from the article carrying surface and fitted into the sliding unit, and comprising a wire arm having a pair of rotating shafts pivotally coupled to be moved between a horizontally unfolded (lowered) position and a vertically folded (raised) position and rotating along an axis allowing the second shelf to expand a surface area of the first shelf when the wire arm is in the vertically folded (raised) position; and a guide provided between the first shelf and the second shelf to support the second shelf when the second shelf is moved by the sliding unit, thereby guiding movement of the second shelf.

25. A refrigerator comprising:

a main body having a storage compartment divided into upper and lower regions by an intermediate partition, the main body including an inner shell defining the storage compartment and an outer shell spaced apart from the inner shell with a thermal-insulating material interposed between the inner shell and the outer shell;

a door to open or close the storage compartment;

a first shelf removably mounted to a rear wall of the inner shell;

a sliding unit slidably coupled to a sidewall of the inner shell to be movable forward or rearward relative to the storage compartment;

a second shelf arranged parallel to the first shelf between the first shelf and the sidewall of the inner shell, the second shelf including an article carrying surface and a coupling frame extending orthogonal to the article carrying surface and coupled to the sliding unit, and comprising a wire arm having a pair of rotating shafts pivotally coupled to be moved between a horizontally unfolded (lowered) position and a vertically folded (raised) position and rotating along an axis allowing the second shelf to expand a surface area of the first shelf when the wire arm is in the vertically folded (raised) position; and a guide provided between the first shelf and the second shelf to support the second shelf when the second shelf is moved by the sliding unit, thereby guiding movement of the second shelf, wherein the coupling frame includes the wire arm vertically pivotally coupled thereto to prevent separation of an article, the wire arm extending along an edge of the article carrying surface at the upper side of the edge.

* * * * *

UNITED STATES PATENT AND TRADEMARK OFFICE

CERTIFICATE OF CORRECTION

PATENT NO. : 8,740,322 B2
APPLICATION NO. : 13/443424
DATED : June 3, 2014
INVENTOR(S) : Moon et al.

It is certified that error appears in the above-identified patent and that said Letters Patent is hereby corrected as shown below:

In the Claims

Column 12, Line 54, Claim 3, after "shelf" delete "so as.".
Column 14, Line 13, Claim 15, delete "edge" and insert -- edge, --, therefor.

Signed and Sealed this
Seventh Day of October, 2014

Michelle K. Lee

Michelle K. Lee
*Deputy Director of the United States Patent and Trademark Office*